US011425941B1

(12) United States Patent
Connelly

(10) Patent No.: US 11,425,941 B1
(45) Date of Patent: Aug. 30, 2022

(54) COMFORT FIT NATURAL BREAST SHAPING NIPPLE CONCEALER

(71) Applicant: MaryMac Revisions, LLC, Mount Pleasant, SC (US)

(72) Inventor: Mary R. Mcleod Connelly, Mount Pleasant, SC (US)

( * ) Notice: Subject to any disclaimer, the term of this patent is extended or adjusted under 35 U.S.C. 154(b) by 0 days.

(21) Appl. No.: 16/678,313

(22) Filed: Nov. 8, 2019

(51) Int. Cl.
*A41C 3/14* (2006.01)
*A41C 3/06* (2006.01)

(52) U.S. Cl.
CPC ..... *A41C 3/144* (2013.01); *A41C 3/065* (2013.01)

(58) Field of Classification Search
CPC ..... A61J 13/00
See application file for complete search history.

(56) References Cited

U.S. PATENT DOCUMENTS 751,415 A * 2/1904 Prindle ..... A61J 13/00 128/890
1,783,512 A * 12/1930 Mather ..... A41C 3/065 450/81
2,047,522 A * 7/1936 Schnaittacher ..... A41C 3/04 450/37
2,082,503 A * 6/1937 Meadows ..... A41C 3/144 450/57
2,163,792 A * 6/1939 Littlehales ..... A61J 13/00 606/201
2,345,649 A * 4/1944 Zimmerman ..... A41C 3/10 450/57
2,448,938 A * 9/1948 Wayne ..... A61F 13/10 604/346
2,570,352 A * 10/1951 La Roe ..... A41C 3/00 450/66
2,630,119 A * 3/1953 Aagesen ..... A61F 13/141 604/374
2,891,544 A * 6/1959 London ..... A61F 13/141 604/379
3,280,818 A * 10/1966 Pankey ..... A41C 3/065 450/81
3,301,254 A * 1/1967 Schickendanz ..... A61F 13/063 128/894
3,356,090 A * 12/1967 Plantinga ..... A61F 13/141 604/368
3,442,268 A * 5/1969 Bird ..... A61F 13/141 604/380
3,588,916 A * 6/1971 Glatt ..... A41D 27/13 2/53
3,814,107 A * 6/1974 Greenblatt ..... A41C 3/10 450/56
3,890,978 A * 6/1975 Nobbs ..... A41C 3/0071 450/61
3,976,083 A * 8/1976 Schmidt ..... A41C 3/00 450/1
4,047,534 A * 9/1977 Thomaschefsky .... A61F 13/141 604/365
4,071,914 A * 2/1978 Silverman ..... A61F 2/52 450/57

(Continued)

*Primary Examiner* — Jocelyn Bravo

(57) ABSTRACT

Comfort fit natural breast shape revealing nipple concealer having concealer stack with multiple tapered layers of selected materials, diameters, and rigidities positioned in between inner and outer layers of a bra or other garment functioning to depress and conceal a women's nipple in a manner that reveals her natural breast shape and is comfortable to wear.

6 Claims, 8 Drawing Sheets

(56) References Cited

U.S. PATENT DOCUMENTS 4,100,621 A * 7/1978 Ettipio ..... A41D 10/00 2/114
4,164,228 A * 8/1979 Weber-Unger ..... A61F 13/141 604/385.07
4,193,404 A * 3/1980 Repke ..... A61F 13/141 604/366
4,333,471 A * 6/1982 Nakai ..... A61F 13/145 128/890
4,553,550 A * 11/1985 Hattori ..... A41C 3/065 450/81
4,557,267 A * 12/1985 Cole ..... A41C 5/005 450/40
4,640,288 A * 2/1987 Hattori ..... A41C 3/065 450/81
4,674,131 A * 6/1987 Broel ..... A41D 27/26 2/105
4,700,699 A * 10/1987 Tollerud ..... A61F 13/141 604/358
4,875,492 A * 10/1989 Mitchell ..... A61F 13/141 128/890
4,992,074 A * 2/1991 Diaz ..... A41C 3/065 2/267
5,017,174 A * 5/1991 Gowrylow ..... A61F 13/141 2/267
5,032,103 A * 7/1991 Larsson ..... A61F 15/008 450/37
5,171,321 A * 12/1992 Davis ..... A61F 2/52 128/890
5,326,305 A * 7/1994 Fochler ..... A61F 13/145 2/267
5,394,889 A * 3/1995 Morrissey ..... A61J 13/00 128/845
5,603,653 A * 2/1997 Hartman ..... A41B 9/12 2/267
5,669,395 A * 9/1997 Thompson ..... A41D 7/006 128/846
5,690,536 A * 11/1997 Madden ..... A61F 13/141 2/267
5,755,611 A * 5/1998 Noble ..... A41C 3/065 450/39
5,782,672 A * 7/1998 Woodley ..... A41C 3/065 2/267
5,843,062 A * 12/1998 Reidmiller ..... A61F 13/141 604/378
5,919,180 A * 7/1999 Raimondo ..... A61F 13/141 604/387
5,998,693 A * 12/1999 Zagame ..... A61F 13/145 602/52
6,036,577 A * 3/2000 Coburn ..... A41C 3/065 450/57
6,039,629 A * 3/2000 Mitchell ..... A61F 13/141 2/267
6,074,272 A * 6/2000 Hebert ..... A61F 13/141 450/37
6,083,080 A * 7/2000 Lawson ..... A41C 3/10 450/39
6,110,005 A * 8/2000 Stephenson ..... A41C 3/10 450/39
6,183,340 B1 * 2/2001 Wen ..... A41C 3/065 2/267
6,200,195 B1 * 3/2001 Furuno ..... A41C 3/065 450/81
6,241,715 B1 * 6/2001 Houser ..... A61F 7/02 450/37
6,338,665 B1 * 1/2002 Dawson ..... A41C 3/065 450/37
6,350,175 B2 * 2/2002 Johnson ..... A41C 3/065 450/57
6,361,397 B1 3/2002 Makovitz et al.
6,371,831 B1 * 4/2002 Dodge ..... A41C 3/065 2/67
6,402,586 B1 * 6/2002 Winik ..... A41C 3/0064 450/1
6,406,351 B1 * 6/2002 Chen ..... A41C 3/12 450/55
6,406,352 B1 * 6/2002 Cheng ..... A41C 3/144 450/55
6,419,548 B1 * 7/2002 Wittes ..... A41C 3/065 2/267
H2062 H * 4/2003 Blaney ..... 602/46
6,695,678 B1 * 2/2004 Foley ..... A61F 13/8405 2/267
6,857,935 B1 * 2/2005 Dohan ..... A41C 3/065 2/244
6,964,596 B1 11/2005 Abramyan
7,152,606 B1 * 12/2006 Schindler ..... A41C 3/065 128/889
7,229,335 B2 * 6/2007 Davis ..... A41C 3/065 450/54
7,404,752 B1 * 7/2008 Karon ..... A41C 3/12 2/53
7,487,779 B2 * 2/2009 Kurz ..... A61F 15/008 128/889
7,566,344 B2 * 7/2009 Hansen ..... A61F 2/52 450/81
7,727,048 B2 * 6/2010 Gransberry ..... A41C 3/144 450/39
8,038,660 B2 * 10/2011 Bruce ..... A61F 13/141 604/346
8,056,563 B2 11/2011 Yamashita
8,118,639 B1 * 2/2012 Boon ..... A41C 3/144 450/37
8,628,507 B1 * 1/2014 Carroll ..... A61F 13/141 604/346
9,408,957 B1 * 8/2016 Levine ..... A61M 1/062
9,517,183 B2 * 12/2016 Ward ..... A61J 13/00
10,492,997 B1 * 12/2019 Portwood ..... A61J 13/00
10,632,021 B2 * 4/2020 Madden ..... A61F 13/141
10,905,173 B1 * 2/2021 Kosak ..... A41F 15/02
10,925,326 B2 * 2/2021 Liu ..... B32B 5/245
2002/0022815 A1 * 2/2002 Yamaji ..... A61F 13/141 604/385.07
2003/0073930 A1 * 4/2003 Morrissey ..... A61F 13/141 600/573
2003/0092356 A1 * 5/2003 Huang ..... A41C 3/10 450/57
2003/0108581 A1 * 6/2003 Silver ..... A61M 35/006 424/401
2003/0162479 A1 * 8/2003 Tonsor ..... A41C 3/10 450/54
2003/0181129 A1 * 9/2003 Getman ..... A41C 3/0057 450/57
2003/0211810 A1 * 11/2003 Raimondo ..... A41C 3/04 450/36
2003/0220048 A1 * 11/2003 Toro ..... A61F 13/51462 450/57
2004/0102134 A1 * 5/2004 Gorski ..... A41C 3/065 450/81
2005/0098258 A1 * 5/2005 Batcha ..... A41F 15/00 156/250
2005/0119631 A1 * 6/2005 Giloh ..... A61F 13/51121 604/367
2005/0239369 A1 * 10/2005 Clark ..... A61J 13/00 450/81
2006/0003668 A1 * 1/2006 Aerts ..... A41H 43/00 450/39
2006/0025039 A1 * 2/2006 Barbour ..... A41D 1/18 450/1
2006/0025044 A1 * 2/2006 Tremblay ..... A41C 3/0007 450/70
2006/0057938 A1 * 3/2006 Huang ..... A61F 13/141 450/81
2006/0252346 A1 * 11/2006 Reinisch ..... A41C 3/0028 450/86
2007/0049163 A1 * 3/2007 Lin ..... A41C 3/10 450/54

(56) References Cited

U.S. PATENT DOCUMENTS

2007/0084390 A1* 4/2007 Angelino ..... B29C 66/8416 112/475.01
2007/0226870 A1* 10/2007 Abbott ..... A41C 3/0014 2/69
2008/0071370 A1* 3/2008 Vinas ..... A61F 2/52 623/7
2008/0268748 A1* 10/2008 Huang ..... A41C 5/005 450/39
2009/0013443 A1* 1/2009 Perras ..... A41F 19/00 2/67
2009/0130953 A1* 5/2009 Gransberry ..... A41C 3/10 450/39
2009/0149114 A1* 6/2009 Horton ..... A41C 3/065 450/54
2009/0298386 A1* 12/2009 Deal ..... A41C 3/065 450/81
2012/0129427 A1* 5/2012 Perez ..... A41C 3/04 450/36
2012/0129428 A1* 5/2012 Taylor ..... A41C 3/04 450/37
2012/0001492 A9 6/2012 Liu
2012/0149278 A1* 6/2012 Liu ..... A41C 3/144 450/57
2013/0171901 A1* 7/2013 Bartl ..... D06M 15/227 442/291
2013/0228186 A1* 9/2013 Ward ..... A61F 13/14 128/890
2014/0273738 A1* 9/2014 Raven ..... A41C 3/144 450/57
2017/0273365 A1* 9/2017 Muhlenfeld ..... A41C 3/12
2017/0280787 A1* 10/2017 Burrell ..... A41C 3/04
2018/0002839 A1* 1/2018 Liao ..... D06P 5/2066
2019/0350276 A1* 11/2019 Thompson ..... A41C 3/144
2020/0022423 A1* 1/2020 Webster ..... A41C 3/144

* cited by examiner

COMFORT FIT NATURAL BREAST SHAPING NIPPLE CONCEALER

GOVERNMENT AGENCY

Not Applicable

CROSS-REFERENCE TO RELATED APPLICATIONS

None

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING, A TABLE, OR A COMPUTER PROGRAM LISTING COMPACT DISC APPENDIX

Not Applicable

STATEMENT REGARDING PRIOR DISCLOSURES BY AN INVENTOR OR JOINT INVENTOR

Not Applicable

TECHNICAL FIELD

The inventive subject matter relates to the field of nipple concealers.

BACKGROUND OF THE INVENTION

Many women experience the problem of having their nipples protrude and become visible through their bras and clothing, particularly when their nipples are erect.

Various bras and nipple products have been invented to attempt to address this problem and numerous patents have been granted in this field. See e.g., U.S. Pat. Nos. 5,782,672; 8,419,502; 7,311,583.

Such existing products suffer from a variety of limitations and drawbacks. Some existing products are ineffective at concealing a woman's nipple and/or the products themselves are visible through a woman's clothing. Some existing products are uncomfortable to wear, as they apply painful pressure or chaffing to a woman's skin around her breast and nipple area and/or limit air circulation and cause her to perspire. Some existing products distort the natural shape and size of a woman's breasts, as they have excess or molded padding.

These problems are particularly troublesome for women with small breasts, who desire to conceal their nipples, but do not require significant structural support to hold their small breasts in place and do not desire to apply silicone disks to their delicate breast skin or wear significant padding that is uncomfortable and highly noticeable relative to the size and shape of their natural breasts.

A novel solution to this problem is needed.

BRIEF SUMMARY OF THE INVENTION

The present invention is directed to a comfort fit natural breast shaping nipple concealer. The inventive subject matter involves a concealer stack with multiple tapered layers of selected materials, diameters, and rigidities positioned in between inner and outer layers of a bra or other garment, such that the concealer stack within the bra or other garment functions to depress and conceal a woman's nipple in a manner that reveals her natural breast shape and is comfortable to wear. The invention is particularly advantageous for women with small breasts, though it is also advantageous for women with breasts of all sizes who desire to conceal their nipples.

Various objects, features, aspects, and advantages of the present invention will become more apparent from the following detailed description of preferred embodiments of the invention, along with the accompanying drawing in which like numerals represent like components.

DETAILED DESCRIPTION OF THE INVENTION

Figure 1:
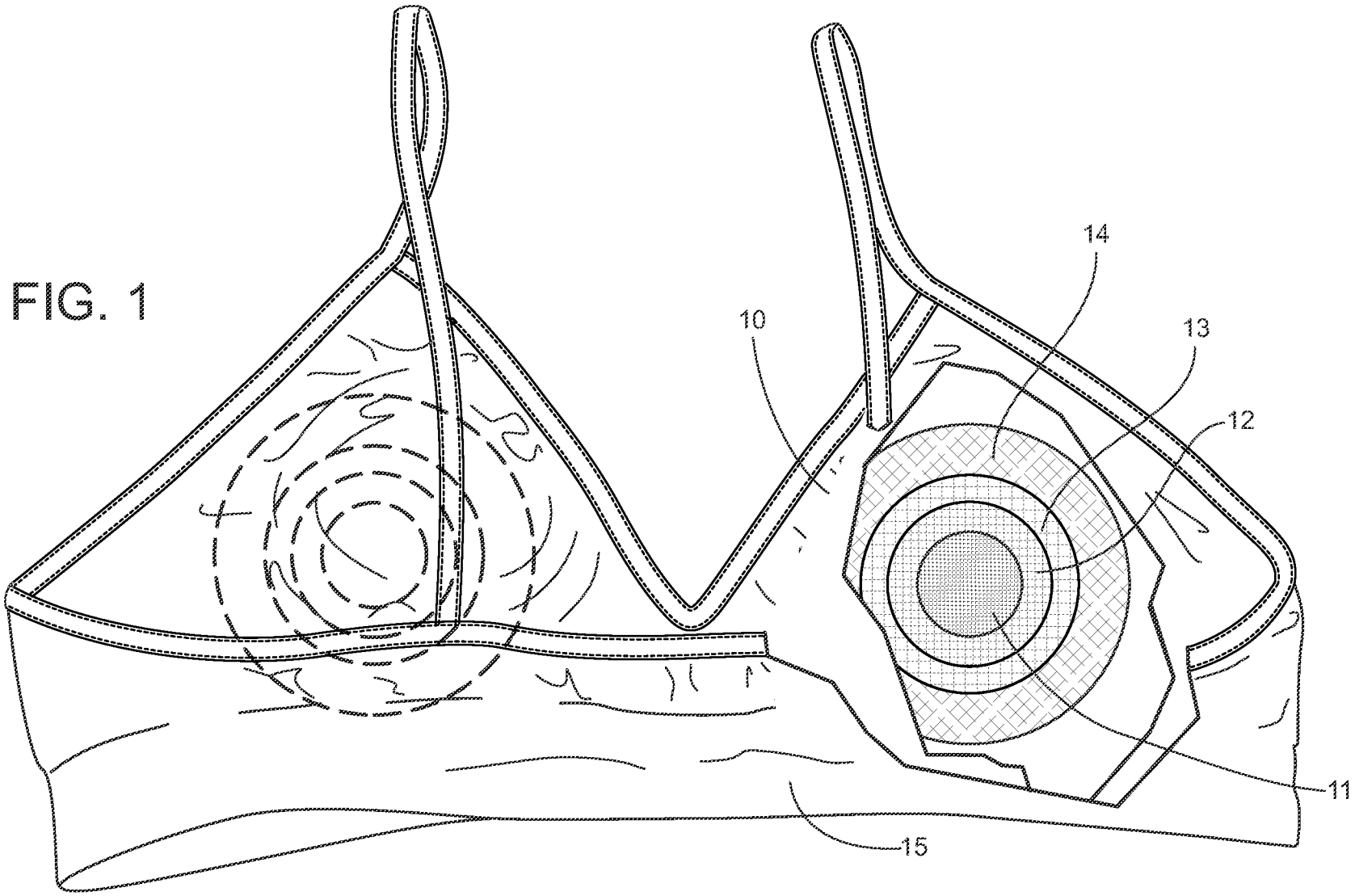
FIG. 1 shows a front elevation cut away view of one embodiment of the invention.

There are many possible embodiments of the invention, some of which are described below.

The figures show various common elements from different views and perspectives. The common elements are numbered 10, 11, 12, 13, 14, and 15 and are described below.

10 and 15 are respectively inner and outer layers of a bra or other garment in between which a concealer stack is positioned. 10 and 15 are preferably comprised of a nylon spandex blend because it is soft, lightweight, flexible, breathable, and washable. 10 and 15 may alternatively be comprised of other materials having similar properties, such as cotton or polyester.

11 and 12 and 13 and 14 are elements of the concealer stack. More particularly, 11 is the inner concealer layer, 12 and 13 are the middle concealer layers, and 14 is the outer concealer layer. When worn by a woman, 11 is in closest proximity to the woman's nipple. The diameter of 11 is accordingly selected to be a diameter no less than the diameter of a woman's nipple, which is typically no less than 1.375 inches in diameter (but may be less than that in some cases, such as with young women).

11 has a smaller diameter and is more rigid, comparatively, than 12 and 13 and 14. 11 is preferably a polyester twill fabric backed with co-polyester heat melt adhesive film, which has preferable properties with respect to rigidity and flexibility and is lightweight and washable. 11 may alternatively be comprised of other materials, such as materials comprised of cotton, nylon, spandex, backed with thermoplastic and/or ester polyurethane film. 11 preferably has a thickness of approximately 0.0145 inches.

12 and 13 have smaller diameters and are more rigid, comparatively, than 14. 12 and 13 are preferably cotton woven interfacing backed with fusible adhesive, which has preferable properties with respect to rigidity and flexibility and is lightweight, breathable, and washable. 12 and 13 may alternatively be comprised of other materials having similar properties, such as materials comprised of cotton, nylon, spandex, backed with thermoplastic and/or ester polyurethane film. Preferably, 12 also has a smaller diameter than 13. Optionally, 13 may be omitted from the concealer stack, such that the concealer stack only has one middle layer. Optionally, additional middle layers may be added to the concealer stack. 12 and 13 each preferably have a thickness of approximately 0.01 inches. In one embodiment of the invention, 12 and 13 are each a material that is 95.7 grams per square meter fusible interfacing 100% cotton woven fabric with 17 mesh polyamide paste dot coating.

14 is preferably a polyester tricot knit interfacing backed with fusible adhesive, which has preferable properties with respect to rigidity and flexibility and is lightweight, breathable, and washable. 14 may alternatively be comprised of other materials having similar properties, such as materials comprised of cotton, nylon, spandex, backed with thermoplastic and/or ester polyurethane film. 14 preferably has a thickness of approximately 0.095 inches. In one embodiment of the invention, 14 is a material that is 41 grams per square meter fusible interfacing 100% polyester fabric coated with 17 mesh polyamide paste dot coating.

11 and 12 and 13 and 14 are preferably circular, but may take other shapes, such as oval or polygonal.

The elements of the concealer stack may have different diameters depending on the size of the bra or other garment. Preferably, depending on the size of the bra or other garment, 11 has a diameter in the approximate range of 1 to 1.75 inches, 12 has a diameter in the approximate range of 1.5 to 2.5 inches, 13 has a diameter in the approximate range of 2.25 to 3.5 inches, and 14 has a diameter in the approximate range of 2.75 to 4.25 inches.

For example, for a bra or other garment size that may typically be designated as "small," 11 is preferably approximately 1.375 inches in diameter, 12 is preferably approximately 2 inches in diameter, 13 is preferably approximately 2.75 inches in diameter, and 14 is preferably approximately 3.5 inches in diameter.

For example, for a bra or other garment size that may typically be designated as "medium," 11 is preferably approximately 1.5 inches in diameter, 12 is preferably approximately 2.25 inches in diameter, 13 is preferably approximately 3 inches in diameter, and 14 is preferably approximately 3.75 inches in diameter.

For example, for a bra or other garment size that may typically be designated as "large," 11 is preferably approximately 1.75 inches in diameter, 12 is preferably approximately 2.5 inches in diameter, 13 is preferably approximately 3.25 inches in diameter, and 14 is preferably approximately 4 inches in diameter.

For additional bra or other garment sizes, the diameters of 11, 12, 13, and 14 with respect to each other are preferably approximately proportional to the examples provided herein.

Preferably, the elements of the concealer stack, 11, 12, 13, and 14, are positioned in between the inner and outer layers of a bra or other garment, 10 and 15, and attached by application of heat that causes the fusible adhesive materials and films in the elements of the concealer stack, 11, 12, 13, and 14, to melt and adhere to each other and to the inner layer 10. Alternatively, the elements of the concealer stack, 11, 12, 13, and 14, may be positioned and attached in between the inner and outer layers of a bra or other garment, 10 and 15, by other applications, such as glues or stitching or laminating.

In further detail, FIG. 1 shows a front elevation cut away view of one embodiment of the invention illustrating the concealer stack, including the elements described above as 11, 12, 13, and 14, positioned in between the inner and outer layers of a bra or other garment, described above as 10 and 15.

Figure 2:
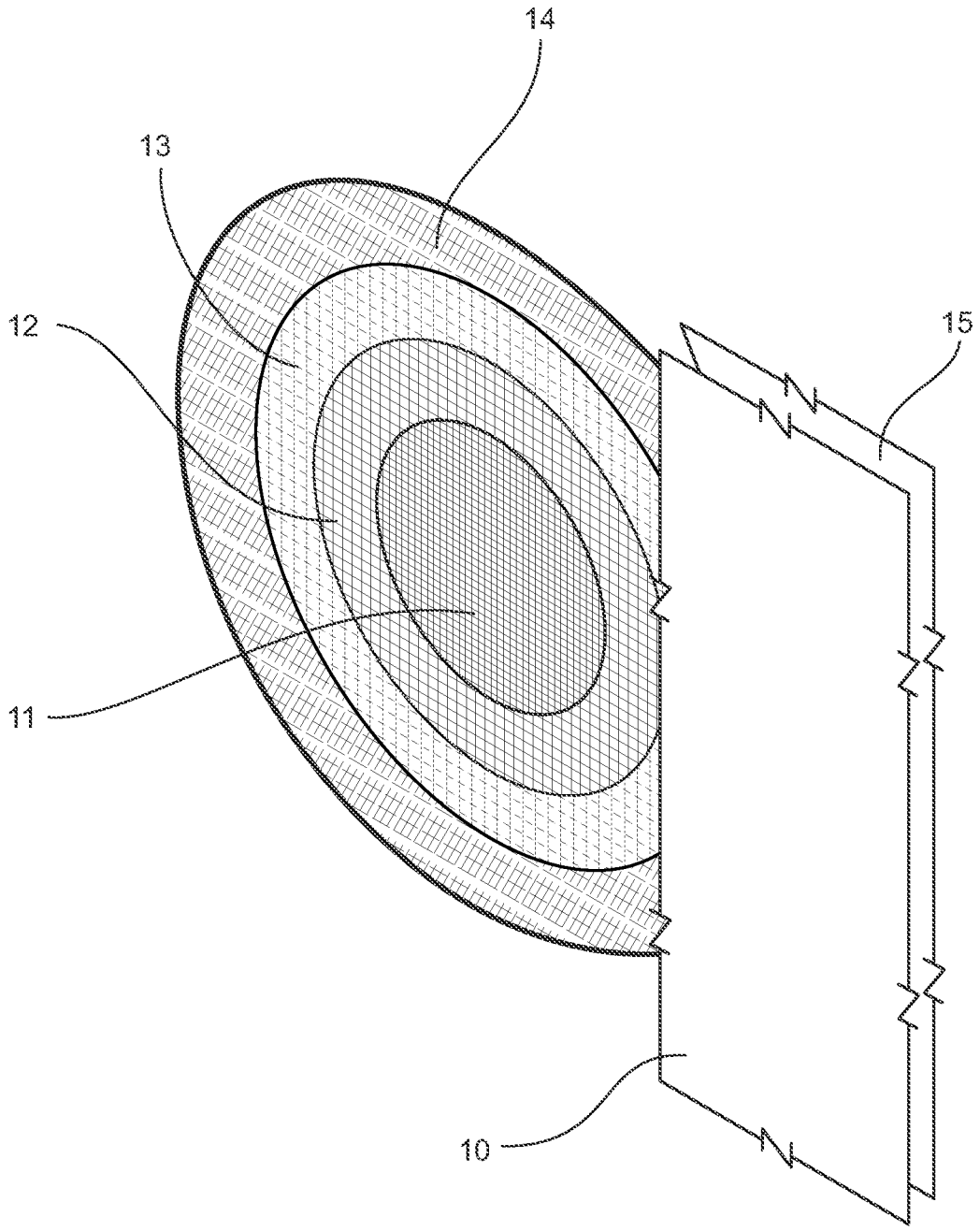
FIG. 2 shows rear perspective view of one embodiment of the invention.

FIG. 2 shows rear a perspective view of one embodiment of the invention illustrating the concealer stack, including the elements described above as 11, 12, 13, and 14, positioned in between the inner and outer layers of a bra or other garment, described above as 10 and 15.

Figure 3:
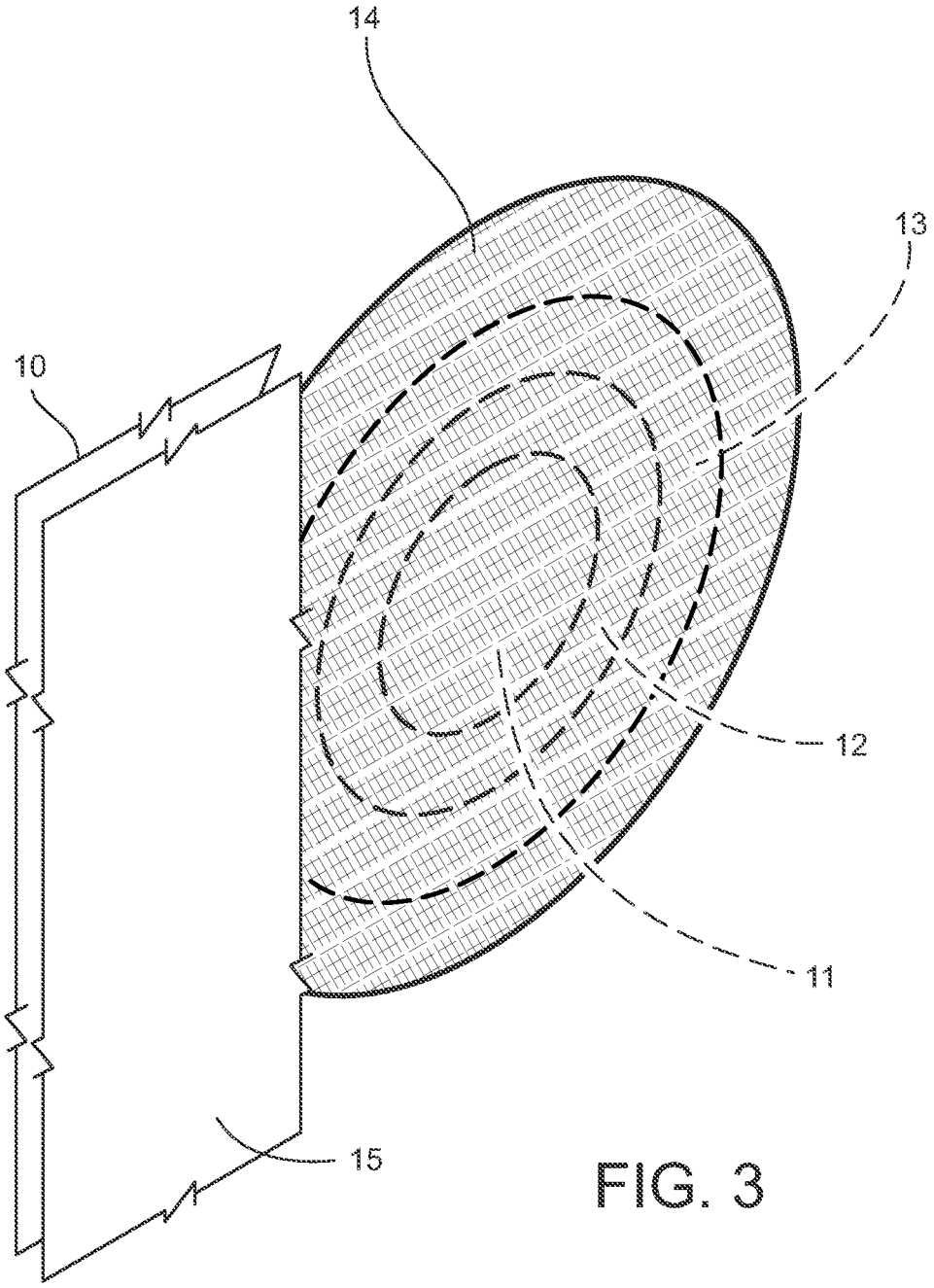
FIG. 3 shows a front perspective view of one embodiment of the invention.

FIG. 3 shows a front perspective view of one embodiment of the invention illustrating the concealer stack, including the elements described above as 11, 12, 13, and 14, positioned in between the inner and outer layers of a bra or other garment, described above as 10 and 15.

Figure 4:
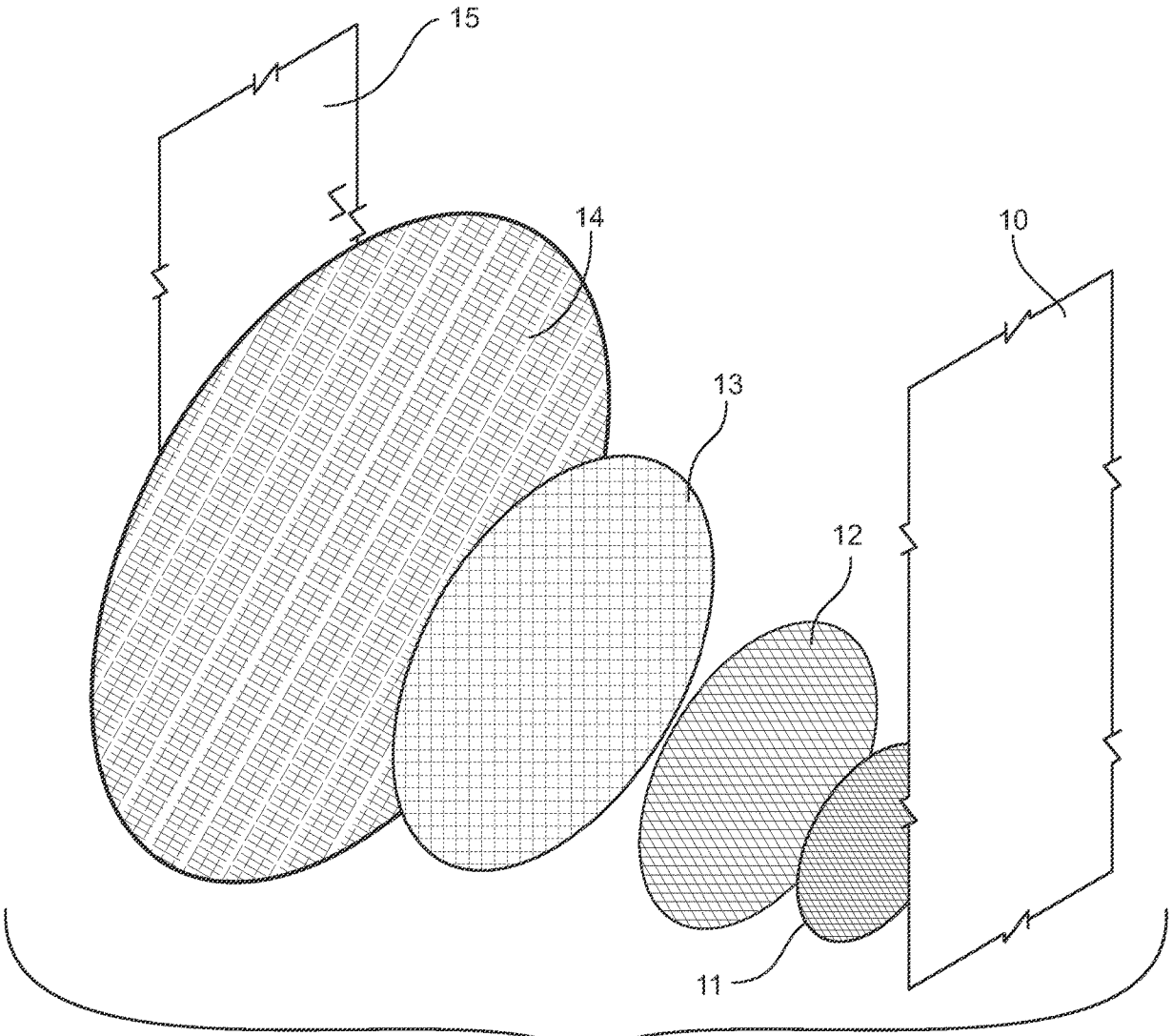
FIG. 4 shows an exploded rear perspective view of one embodiment of the invention.

FIG. 4 shows an exploded rear perspective view of one embodiment of the invention illustrating the concealer stack, including the elements described above as 11, 12, 13, and 14, positioned in between the inner and outer layers of a bra or other garment, described above as 10 and 15.

Figure 5:
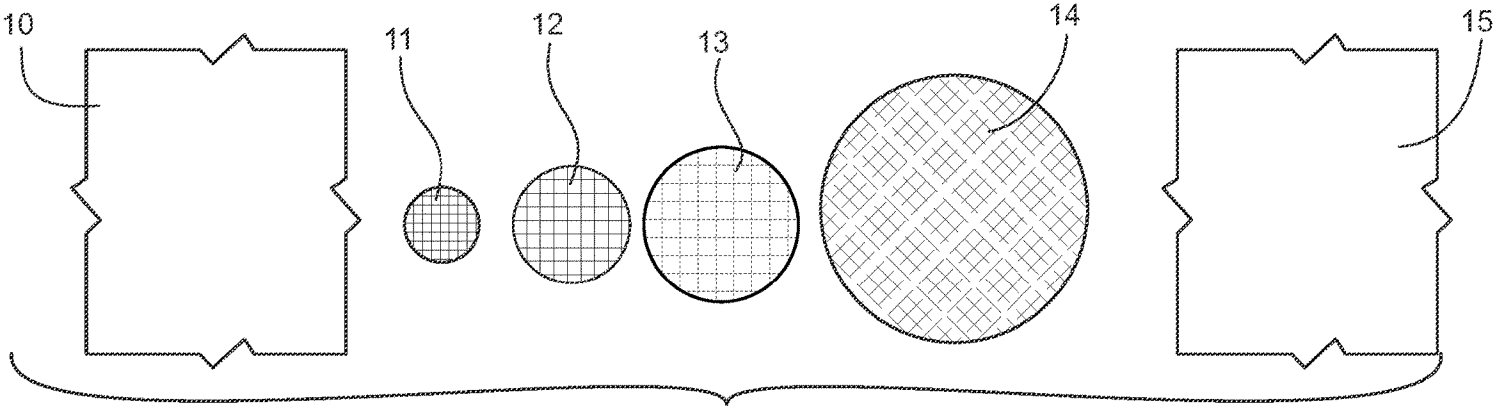
FIG. 5 shows an exploded front elevation view of one embodiment of the invention.

FIG. 5 shows an exploded front elevation view of one embodiment of the invention illustrating the concealer stack, including the elements described above as 11, 12, 13, and 14, arranged in between the inner and outer layers of a bra or other garment, described above as 10 and 15.

Figure 6:
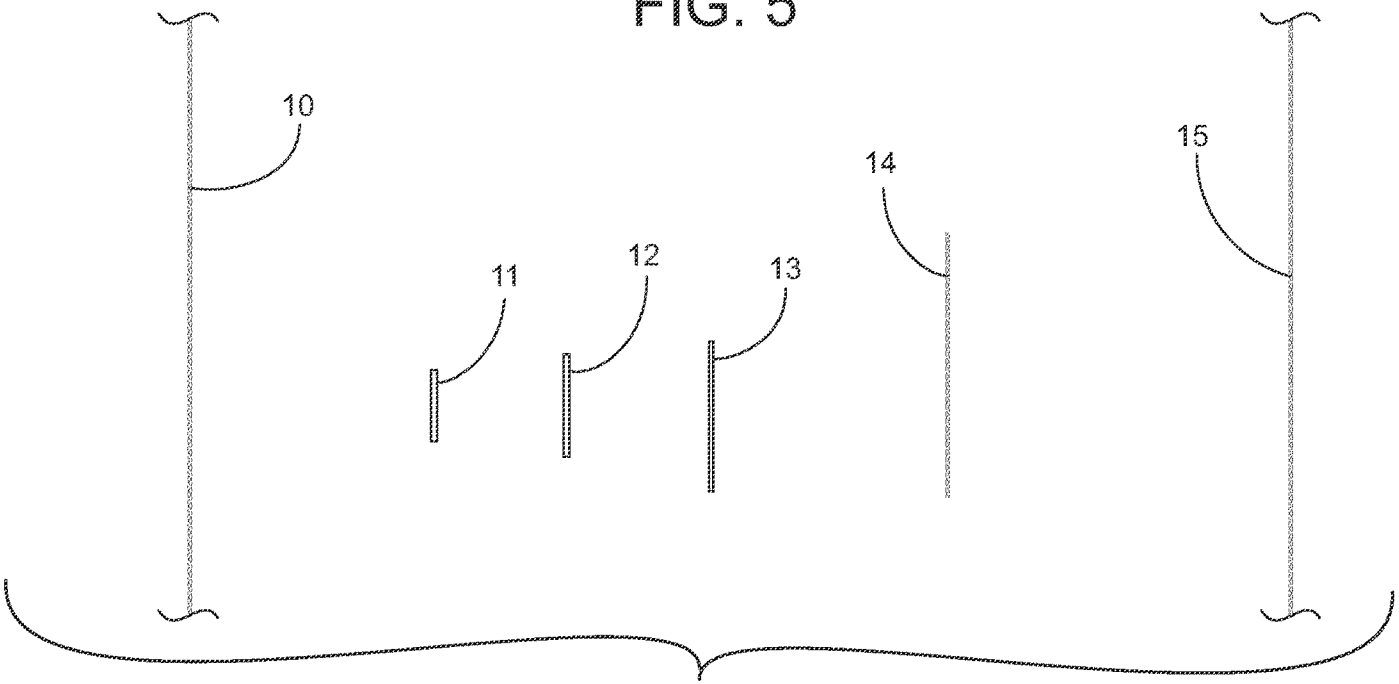
FIG. 6 shows an exploded side elevation view of one embodiment of the invention.

FIG. 6 shows an exploded side elevation view of one embodiment of the invention illustrating the concealer stack, including the elements described above as 11, 12, 13, and 14, arranged in between the inner and outer layers of a bra or other garment, described above as 10 and 15.

Figure 7:
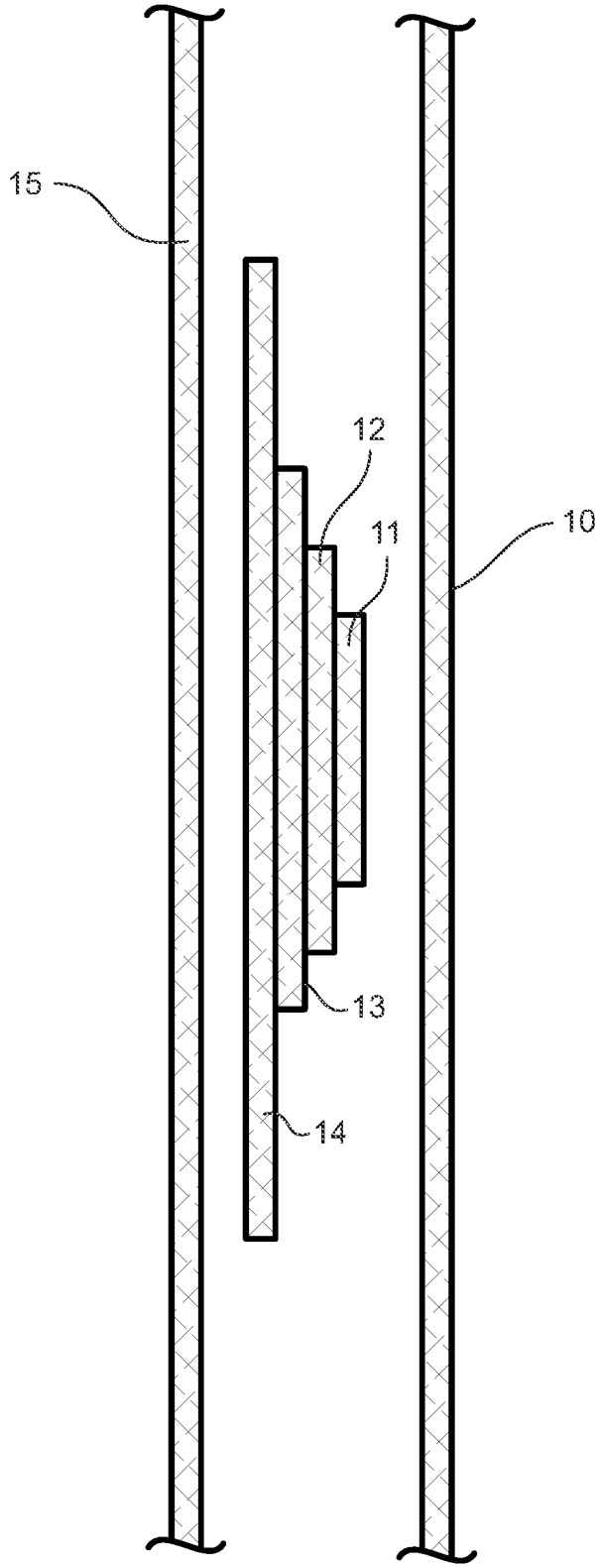
FIG. 7 shows a side elevation view of one embodiment of the invention.

FIG. 7 shows a side elevation view of one embodiment of the invention illustrating the concealer stack, including the elements described above as 11, 12, 13, and 14, arranged in between the inner and outer layers of a bra or other garment, described above as 10 and 15.

Figure 8:
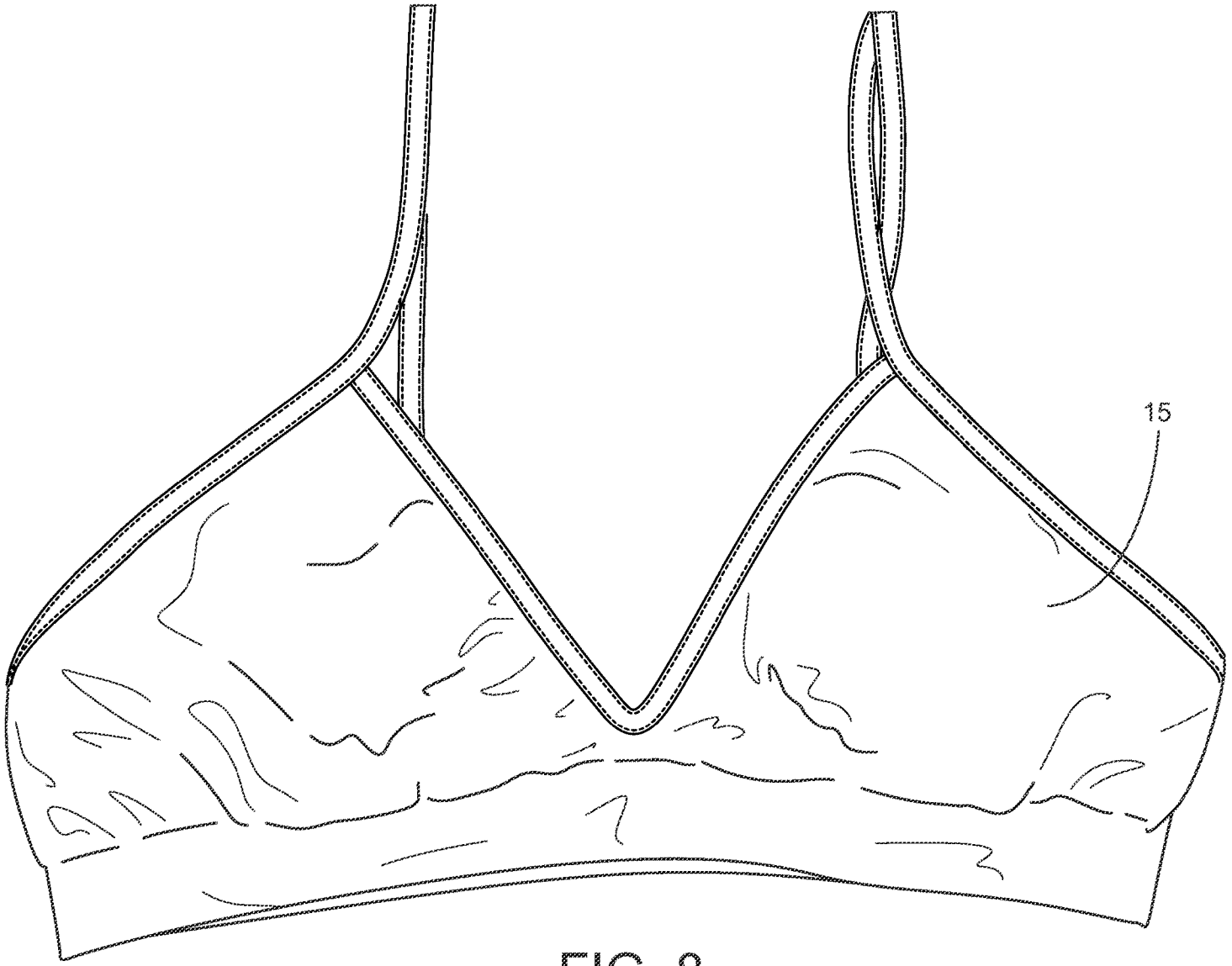
FIG. 8 shows a front elevation view of one embodiment of the invention.

FIG. 8 shows a front elevation view of one embodiment of the invention illustrating the outer layer of the bra described above as 15, with the concealer stack not visible.

Figure 9:
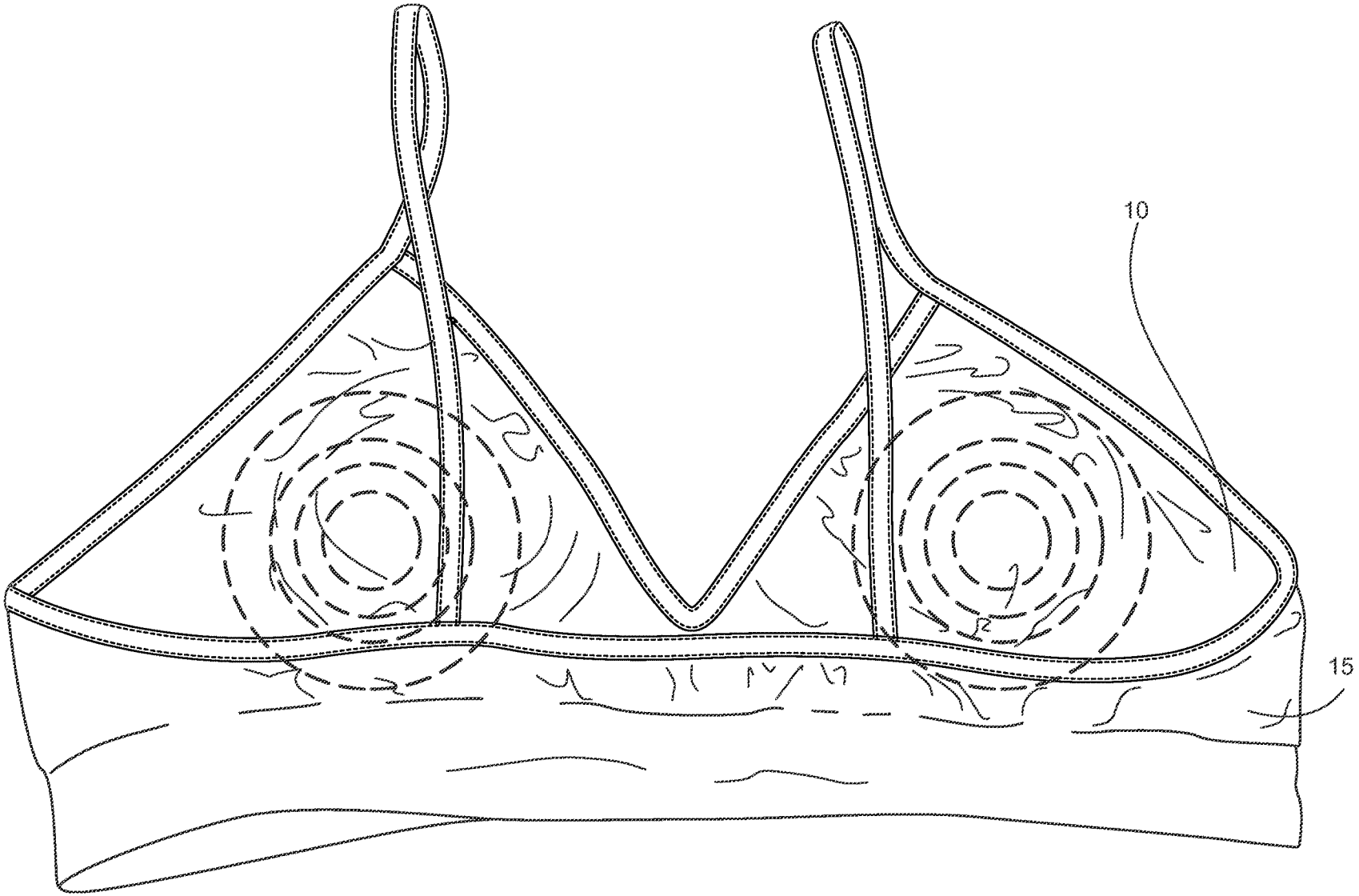
FIG. 9 shows a rear elevation view of one embodiment of the invention.

FIG. 9 shows a rear elevation view of one embodiment of the invention illustrating the inner layer of the bra described above as 10, with the concealer stack not visible.

While the foregoing written description of the invention enables one of ordinary skill to make and use what is considered presently to be the best mode thereof, those of ordinary skill will understand and appreciate the existence of variations, combinations, and equivalents of these specific embodiments. The invention should therefore not be limited by the above described embodiments, but shall include all embodiments within the scope and spirit of the invention.

The invention claimed is:

1. A nipple concealing bra comprising:

a bra having an inner bra layer and an outer bra layer; and a concealer stack; the concealer stack comprising at least three concentric circular layers of decreasing material rigidity and thickness and increasing flexibility, the at least three concentric circular layers including a smallest circular layer, a second smallest circular layer, and a largest circular layer, wherein the smallest circular layer is the most rigid, thickest, and least flexible of the at least three concentric circular layers, and the largest circular layer is the least rigid, thinnest, and most flexible of the at least three concentric circular layers;

wherein the concealer stack is positioned between the inner bra layer and the outer bra layer and oriented such that the smallest circular layer is directly adjacent to the inner bra layer;

wherein the smallest circular layer in the concealer stack comprises a polyester twill fabric backed with copolyester heat melt adhesive film, the second smallest circular layer in the concealer stack comprises a cotton woven interfacing backed with fusible adhesive, and the largest circular layer in the concealer stack comprises a polyester tricot knit interfacing backed with fusible adhesive.

2. The nipple concealing bra of claim 1, wherein the smallest circular layer in the concealer stack has a diameter of approximately 1.375 inches, the second smallest circular layer in the concealer stack has a diameter of approximately 2.0 inches, and the largest circular layer in the concealer stack has a diameter of approximately 3.5 inches in diameter.

3. The nipple concealing bra of claim 1, wherein the smallest circular layer in the concealer stack has a diameter of approximately 1.5 inches, the second smallest circular layer in the concealer stack has a diameter of approximately 2.25 inches, and the largest circular layer in the concealer stack has a diameter of approximately 3.75 inches in diameter.

4. The nipple concealing bra of claim 1, wherein the smallest circular layer in the concealer stack has a diameter of approximately 1.75 inches, the second smallest circular layer in the concealer stack has a diameter of approximately 2.50 inches, and the largest circular layer in the concealer stack has a diameter of approximately 4.0 inches in diameter.

5. The nipple concealing bra of claim 1, wherein the at least three concentric circular layers of the concealer stack are attached to each other by application of heat.

6. The nipple concealing bra of claim 1, wherein the concealer stack is attached to the inner bra layer by application of heat.

* * * * *